US008059976B2

(12) United States Patent
Matsui et al.

(10) Patent No.: US 8,059,976 B2
(45) Date of Patent: Nov. 15, 2011

(54) IMAGE FORMING APPARATUS WITH SHEET FEEDING RETRY FUNCTION

(75) Inventors: Noriaki Matsui, Abiko (JP); Kiyoshi Okamoto, Moriya (JP); Toru Ono, Toyota (JP)

(73) Assignee: Canon Kabushiki Kaisha (JP)

( * ) Notice: Subject to any disclaimer, the term of this patent is extended or adjusted under 35 U.S.C. 154(b) by 558 days.

(21) Appl. No.: 11/778,591

(22) Filed: Jul. 16, 2007

(65) Prior Publication Data

US 2008/0025737 A1 Jan. 31, 2008

(30) Foreign Application Priority Data

Jul. 25, 2006 (JP) ..... 2006-202587
Jun. 27, 2007 (JP) ..... 2007-169490

(51) Int. Cl.
*G03G 15/00* (2006.01)

(52) U.S. Cl. ..... 399/18; 399/19

(58) Field of Classification Search ..... 399/394, 399/18, 21

See application file for complete search history.

(56) References Cited

U.S. PATENT DOCUMENTS 4,110,032 A * 8/1978 Hubbard et al. ..... 399/18
6,032,944 A * 3/2000 Lee ..... 271/110
6,351,315 B2 * 2/2002 Kusumoto ..... 358/1.14
6,650,436 B1 * 11/2003 Hamamoto et al. ..... 358/1.9
6,957,022 B2 10/2005 Hirai et al.
7,016,642 B2 * 3/2006 Morita ..... 399/394
7,052,007 B2 * 5/2006 Yang et al. ..... 271/10.02
7,376,364 B2 * 5/2008 Fujita ..... 399/16

FOREIGN PATENT DOCUMENTS

CN 1524776 A 9/2004
JP 3-279142 A 12/1991
JP 5-221561 A 8/1993
JP 10-123908 A 5/1998
JP 2003-167485 A 6/2003

OTHER PUBLICATIONS

Office Action issued in corresponding CN application No. 200710129773.X, dated Jan. 16, 2009.

* cited by examiner

*Primary Examiner* — Anthony Nguyen
(74) *Attorney, Agent, or Firm* — Rossi Kimms & McDowell LLP

(57) ABSTRACT

After the start of an image formation operation, feeding of a sheet on which an image is to be formed is started, and an image formed on an image carrier is transferred onto the fed sheet. On the other hand, after the start of the image formation operation, in a case that the sheet has not been detected within a predetermined time period in a predetermined position on the upstream side of a transfer position, transfer is stopped, and after the stoppage of the transfer, re-feeding of the sheet is performed. By the re-feeding, in a case that the sheet has been detected in the predetermined position, formation of an image to be transferred onto the sheet is started, then the timing of start of the feeding of the sheet is delayed from the timing of start of the feeding in normal times.

5 Claims, 8 Drawing Sheets

IMAGE FORMING APPARATUS WITH SHEET FEEDING RETRY FUNCTION

BACKGROUND OF THE INVENTION

1. Field of the Invention

The present invention relates to a technique of starting an image forming operation and then starting feeding of a sheet and forming an image on the sheet.

2. Description of the Related Art

In a conventional image forming apparatus using an electrophotographic method, when it is checked that a sheet has been fed to a predetermined position, image formation on a photosensitive drum is started (sheet first method). Then, the electrostatic latent image on the photosensitive drum is developed, and the developed image is transferred onto the sheet (direct transfer method). On the other hand, in a color image forming apparatus using the electrophotographic method, images corresponding to respective colors formed on plural photosensitive drums are temporarily transferred onto an intermediate transfer member such that they are superimposed on each other. Then, a full color image where the plural color images are superimposed is transferred onto a sheet (intermediate transfer method). The intermediate transfer method, proposed in view of occurrence of color shift due to variations of materials of sheets, has become popular.

However, in the above intermediate transfer method, when sheet feeding is started and then image formation processing on the respective photosensitive drums is started, the time period from the start of image formation operation to the transfer is long, therefore the printing efficiency is not improved. Accordingly, in the intermediate transfer method, the printing efficiency is improved by adopting a first image formation method of starting image formation processing on the photosensitive drums before start of sheet feeding.

In the former first sheet method, as the image formation processing is started on the presumption that the sheet has been fed to the predetermined position, variations in feeding time in accordance with type of the sheet or the like can be easily handled. On the other hand, in the latter first image formation method, as the image formation processing is started before it is checked whether or not the sheet feeding has been normally performed, there is a probability that the sheet feeding cannot follow the image formation processing.

As a technique for detecting such inconvenience upon sheet feeding, Japanese Patent Application Laid-Open No. 03-279142 proposes execution of sheet feeding retry upon occurrence of paper separation failure. Further, Japanese Patent Application Laid-Open No. 10-123908 discloses, in reading and duplication of an original, stopping an original reading operation when sheet feeding is delayed. Further, Japanese Patent Application Laid-Open No. 05-221561 discloses, in continuous sheet feeding, suspending an image formation operation in a current image formation cycle upon occurrence of delay of sheet feeding, instead of performing processing in the case of paper jam, and then when the sheet arrives at an image forming position in the next image formation cycle, continuing the image formation operation.

However, in these conventional techniques, as image formation by the sheet first method is presumed, the techniques are not appropriate for image formation by the first image formation method. That is, in the above-described first image formation method, it is presumed that a sheet follows a formed image on a photosensitive drum or an intermediate transfer member. However, a trouble occurs when a sheet cannot follow a formed image due to variations of sheets, which gets recognized as paper jam.

SUMMARY OF THE INVENTION

An aspect of the present invention is to eliminate the above-mentioned conventional problems.

Moreover, another aspect of the present invention is to provide a technique for, in an image forming apparatus using the image formation first method, when sheet feeding can not follow a formed image, performing image formation processing and sheet feeding again, thereby reducing occurrence of paper jam.

According to an aspect of the present invention, there is provided an image forming apparatus comprising:

a sheet containing unit configured to contain sheets;

a feeding unit configured to feed a sheet from said sheet containing unit;

a detection unit configured to detect presence/absence of the sheet which has been fed by said feeding unit;

an image forming unit configured to form an image on an image carrier;

a transfer unit configured to transfer the image formed on the image carrier onto the sheet; and a control unit configured to start feeding of the sheet by said feeding unit so that said detection unit detects the presence of the sheet after start of image formation by said image forming unit, and cause said transfer unit to transfer the image formed on the image carrier onto the sheet;

wherein in a case that said detection unit does not detect the sheet within a predetermined time period from the start of the feeding of the sheet by said feeding unit, said control unit stops the transfer of the image by said transfer unit, and starts formation of an image to be formed on the sheet by said image forming unit in response to detection of the sheet by said detection unit within the predetermined time period after restart of the feeding of the sheet by said feeding unit.

Further, according to another aspect of the present invention, there is provided an image forming apparatus comprising:

a feeding unit configured to feed a sheet along a feeding path;

an image forming unit configured to form an image corresponding to image data on an image carrier;

a control unit configured to start feeding of a sheet, on which the image is to be formed, by said feeding unit, and transfer the image formed on said image carrier onto the sheet fed by said feeding unit at a transfer position; and a detection unit configured to detect presence/absence of the sheet which has been fed by said feeding unit on an upstream side of the transfer position on the feeding path;

wherein said control unit starts feeding of the sheet by said feeding unit so that said detection unit detects the presence of the sheet after start of an image formation operation by said image forming unit, and said transfer control unit stops feeding of the sheet, after the start of the image formation operation, in a case that the sheet is not detected by said detection unit within a predetermined time period, and then controls said feeding unit to feed again the sheet and starts the image formation operation of the image to be formed on the sheet by said image forming unit, in a case that said detection unit detects the sheet fed again.

Note that the means for solving the problem does not give all the features of the present invention, but other claims described in the scope of claims and combinations of the features can be included in the invention.

Further features and aspects of the present invention will become apparent from the following description of an exemplary embodiment with reference to the attached drawings.

BRIEF DESCRIPTION OF THE DRAWINGS

The accompanying drawings, which are incorporated in and constitute a part of the specification, illustrate the embodiment of the invention and, together with the description, serve to explain the principles of the invention.

DESCRIPTION OF THE EMBODIMENT

An embodiment of the present invention will now herein be described in detail with reference to the accompanying drawings. It should be noted that the embodiments below are not intended to limit the present invention set forth in the claims and that not all of the combinations of features described in the embodiments are necessarily essential as means for attaining the objects of the invention.

Figure 1:
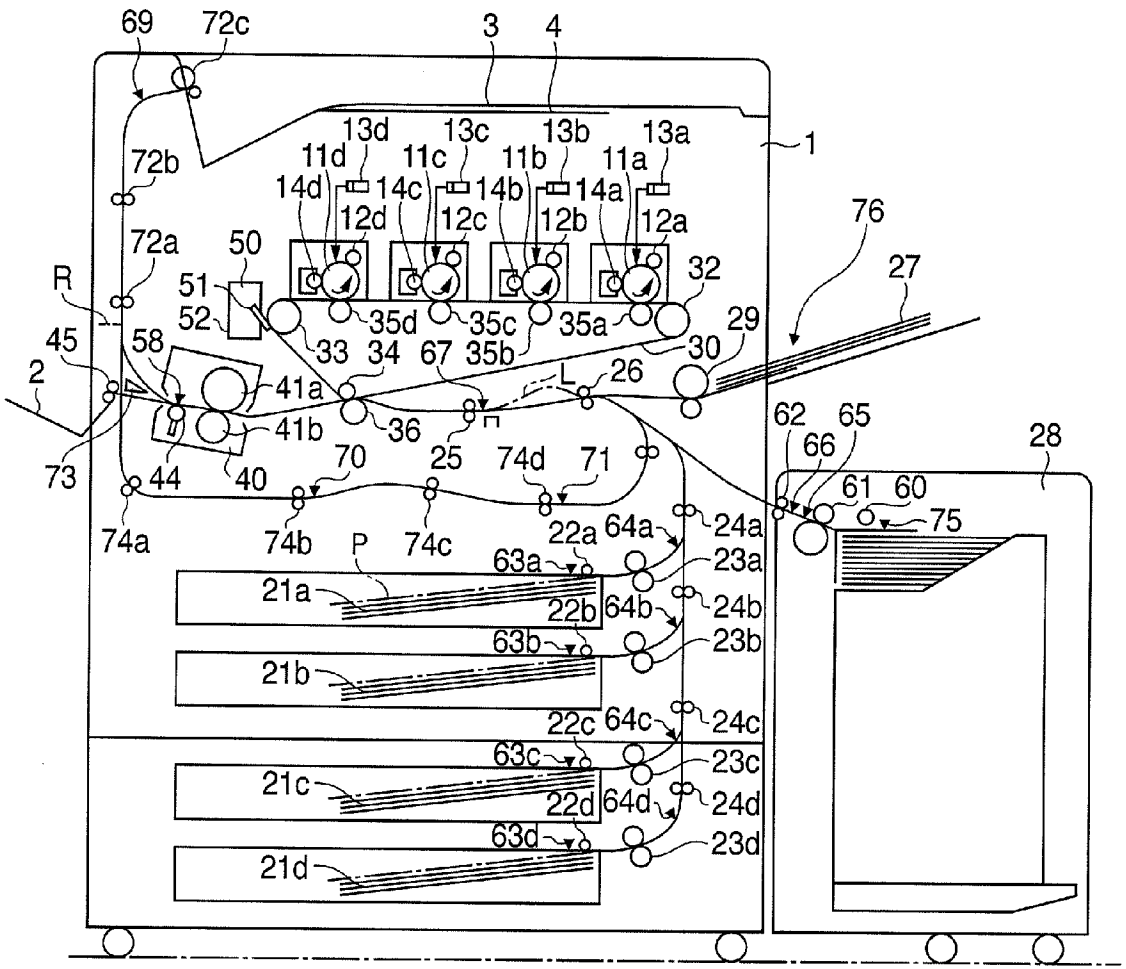
FIG. 1 depicts a functional cross-sectional view showing the functions of an image forming apparatus (laser printer) according to an exemplary embodiment of the present invention.

FIG. 1 depicts a functional cross-sectional view showing the functions of an image forming apparatus (laser printer) according to an exemplary embodiment of the present invention.

Reference numeral 1 denotes a main body of the image forming apparatus (laser printer); numeral 2 denotes a face-up sheet discharge tray on which a discharged printed sheet, with its printed surface up, is stacked; numeral 3 denotes a face-down sheet discharge tray on which a discharged printed sheet, with its printed surface down, is stacked; numeral 4 denotes a console unit having plural keys and buttons operated by an operator and a display unit to display messages for a user, apparatus statuses or the like; reference symbols 11*a* to 11*d* denote photosensitive drums as photoconductors for formation of Bk (black), C (cyan), M (magenta) and Y (yellow) images; reference symbols 12*a* to 12*d* denote roller chargers to uniformly charge the respectively corresponding photosensitive drums; reference symbols 13*a* to 13*d* denote scanners (latent image forming units) to emit laser light respectively corresponding to Bk, C, M and Y image data; and reference symbols 14*a* to 14*d* denote developing units to develop electrostatic latent images formed on the respectively corresponding photosensitive drums with Bk, C, M and Y toner. The respective color images developed on the respective photosensitive drums are transferred with transfer rollers 35*a* to 35*d* onto an intermediate transfer member 30 and superimposed on each other on the intermediate transfer member 30.

Reference symbols 21*a* to 21*d* denote sheet cassettes respectively holding plural sheets P; reference symbols 22*a* to 22*d* denote pick-up rollers to respectively feed the sheet P one by one from the respectively corresponding sheet cassettes 21*a* to 21*d*; reference symbols 23*a* to 23*d* denote feed rollers; reference symbols 24*a* to 24*d* denote drawing rollers; reference numeral 25 denotes a registration roller; and numeral 26 denotes a feeding roller provided in front of the registration roller 25.

Numeral 27 denotes a manual feed tray; numeral 28 denotes a deck on which plural sheets are stacked and; numeral 29 denotes a feeding roller. The intermediate transfer member 30 is a belt type image carrier on which developed respective color images, superimposed on each other, are held. A driving roller 32 transmits rotation of a driving motor to the intermediate transfer member 30 thereby rotate-moves the intermediate transfer member 30 in a clockwise direction. Numeral 33 denotes a tension roller to maintain appropriate tension of the intermediate transfer member 30 by pressure of a spring (not shown); and numeral 34 denotes a driven roller, holding the intermediate transfer member 30 between the driven roller 34 and a secondary transfer roller 36, to form a secondary transfer area. Reference symbols 35*a* to 35*d* denote primary transfer rollers to transfer toner images onto the intermediate transfer member 30. Upon transfer, a high voltage is applied to the primary transfer rollers 35*a* to 35*d* from a high voltage source 201 shown in FIG. 2. The secondary transfer roller 36 is used for transfer of an image formed on the intermediate transfer member 30 onto the sheet P. Upon transfer, the high voltage is applied to the secondary transfer roller 36 from the high voltage source 201. Numeral 40 denotes a fixing unit 40 having a fixing roller 41*a* which includes a heat source such as a halogen heater and a pressure roller 41*b* to press the sheet P, held between the fixing roller 41*a* and the pressure roller 41*b* (the roller 41*b* may also include a heat source). Numeral 44 denotes an inner sheet discharge roller included in the fixing unit 40 to feed the sheet P discharged from the pair of fixing roller 41*a* and the pressure roller 41*b*; and numeral 45 denotes an outer sheet discharge roller. Numeral 50 denotes a cleaning unit to clean an image forming surface of the intermediate transfer member 30; numeral 51 denotes a cleaner blade of e.g. polyurethane rubber; and numeral 52 denotes a waste toner box to collect waste toner.

Numeral 60 denotes a pick-up roller; numeral 61 denotes a sheet feeding roller; numeral 62 denotes a drawing roller; reference symbols 63*a* to 63*d* denote cassette sheet presence/absence sensors in the respective sheet cassettes 21*a* to 21*d*; reference symbols 64*a* to 64*d* denote sensors to detect presence/absence of sheet on respective sheet feeding paths; numeral 65 denotes a deck sheet feeding sensor; numeral 66 denotes a deck drawing sensor; numeral 67 denotes a registration sensor to detect presence/absence of sheet on the registration roller 25; numeral 58 denotes an inner sheet discharge sensor provided in the fixing unit 40; numeral 69 denotes a face-down sheet discharge sensor; numeral 70 denotes a double side pre-registration sensor, provided on a feeding path for double-sided printing, to detect presence/absence of sheet on a roller 74*b*; numeral 71 denotes a paper re-feed sensor provided on the feeding path for double-sided printing; reference symbols 72*a* to 72*c* denote rollers for reversal; numeral 73 denotes a switching flapper for switching of feeding path upon double-sided printing; reference symbols 74*a* to 74*d* denote rollers to feed the sheet P on the feeding path for double-sided printing; numeral 75 denotes a sheet presence/absence sensor in the deck 28; and numeral 76 denotes a manual feed tray sheet presence/absence sensor to detect presence/absence of the sheet P on the manual feed tray 27. Further, alphabet L denotes a loop of the sheet P; and alphabet R denotes a reverse position of the sheet P. The above-described pick-up rollers 22*a* to 22*d*, the feed rollers 23*a* to 23*d*, the drawing rollers 24*a* to 24*d*, the feeding roller 26, the feeding roller 29, the pick-up roller 60, the sheet feeding roller 61, the drawing roller 62, and the rollers 74*a* to 74*d* form a sheet feeding unit. Note that the sensors for detecting the sheets P fed from the respective sheet cassettes 21*a* to 21*d* are not limited to the sensors 64*a* to 64*d*, but other sensors or the like may be employed.

Figure 2:
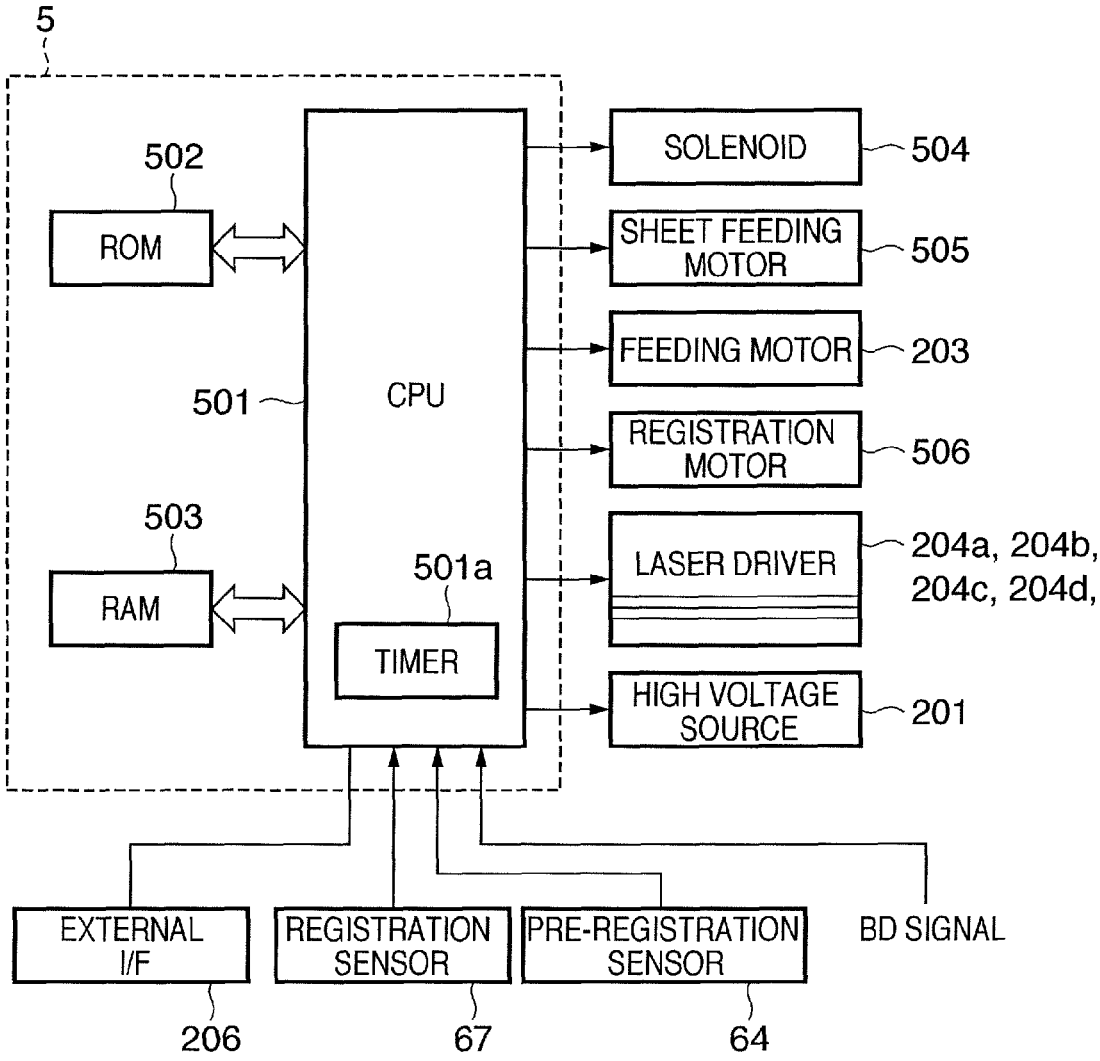
FIG. 2 is a block diagram showing the configuration of a control unit of the image forming apparatus according to the exemplary embodiment and its input and output signals.

The image forming apparatus 1, briefly, has an image forming unit (4 stations a to d respectively having the same structure), the sheet feeding unit, an intermediate transfer unit, a feeding unit, the fixing unit 40, a console unit 4, an image controller 3000 (FIG. 3), and a control unit 5 (FIG. 2). In a color print mode, image formation is performed using all the 4 stations a to d, while in a monochrome print mode, image formation is performed using only 1 station. That is, during the monochrome print mode, the station a is used.

Next, the respective constituent elements will be described.

The image forming unit has the photosensitive drums 11*a* to 11*d*, the roller chargers 12*a* to 12*d*, the scanners 13*a* to 13*d*, the developing units 14*a* to 14*d*, and the primary transfer rollers 35*a* to 35*d*.

The photosensitive drums 11*a* to 11*d* are respectively supported on their center, and rotate-driven in the direction indicated with an arrow by a drum driving motor (not shown). The respective roller chargers (12*a* to 12*d*), the respective scanners (13*a* to 13*d*), and the respective developing units (14*a* to 14*d*) are provided to be opposite to the respective peripheral surfaces of the photosensitive drums 11*a* to 11*d*. The roller chargers 12*a* to 12*d* respectively uniformly charge the surfaces of the respective photosensitive drums (11*a* to 11*d*).

Next, the respective scanners 13*a* to 13*d* emit light beams (e.g. laser light) modulated in correspondence with image signals corresponding to the respective colors on polygonal rotating mirrors rotating at a constant angular velocity, such that reflection light reflected from the polygonal rotating mirrors, as scan light, expose-scan on the photosensitive drums 11*a* to 11*d*. Thus electrostatic latent images corresponding to the image signals for the respective colors are formed on the respective photosensitive drums. Note that the laser light corresponding to the respective colors are emitted from respective corresponding semiconductor lasers by laser drivers 204*a* to 204*d* (see FIG. 2).

The scanners 13*a* to 13*d* respectively have a beam detect sensor (BD sensor) to detect the reflection light from the polygonal rotating mirror. The status of image formation can be grasped by counting the number of laser light emission to the BD sensor (BD signals). The scanner 13*a* for exposure based on the black image signal supplies a signal, obtained by dividing the frequency of the BD signal in a predetermined frequency dividing ratio, to a CPU 501 (FIG. 2). Further, the developing units 14*a* to 14*d*, containing 4 color (yellow, cyan, magenta, black or the like) developer (toner), develop the electrostatic latent images formed on the respective photosensitive drums 11*a* to 11*d*. Then the visible images developed as above are transferred onto the intermediate transfer member 30. Note that the start of laser light exposure for image formation is performed in correspondence with an image formation start signal outputted from the control unit 5 in FIG. 2 to be described later.

Next, the sheet feeding unit will be described.

The sheet feeding unit has a member to contain the sheets P, a roller to feed the sheet P, a sensor to detect presence/absence of the sheet P, and a guide (not shown) to feed the sheet P along the feeding path. The deck 28 can hold a large number of sheets P. The pick-up rollers 22*a* to 22*d* may feed plural sheets P, but the respective feed rollers 23*a* to 23*d* separately feed the sheets P one by one infallibly. The sheets P, respectively separated with the feed rollers 23*a* to 23*d*, are further fed with the respective drawing rollers 24*a* to 24*d* and the feeding roller 26 to a position of the registration roller 25. The pick-up roller 22*a* and the feed roller 23*a* are rotate-driven by a sheet feeding motor 505 (FIG. 2) to be described later, and the drawing roller 24*a* is rotate-driven by a feeding motor 203 (FIG. 2). Similarly, the pick-up roller 22*b* and the feed roller 23*b* are rotate-driven by other motor (not shown) than that for the drawing roller 24*b*. That is, the pick-up rollers 22*a* to 22*d* and the feeding rollers 23*a* to 23*d* are driven by other motors (not shown) than those for the drawing rollers 24*a* to 24*d*. Further, when a solenoid 504 (FIG. 2) is actuated, the pick-up roller 22*a* performs an operation to feed the sheet P by a gear-and-cam action. This operation is similarly performed in the cases of the pick-up rollers 22*b* to 22*d*.

The sheets P stacked on the manual feed tray 27 are separately fed one by one with the feeding roller 29, and fed by rotation of the feeding roller 26 to the position of the registration roller 25. Further, the sheets P contained in the deck 28 are fed by plural sheets to the position of the sheet feeding roller 61 by rotation of the pick-up roller 60, separately fed one by one with the sheet feeding roller 61 infallibly, and fed to the drawing roller 62. Further, the sheet P is fed to the registration roller 25 by rotation of the feeding roller 26. The registration roller 25 is rotate-driven by a registration motor 506 (FIG. 2) to be described later. Further, the feeding roller 26 and the feeding roller 29 are rotate-driven by a pre-registration motor (not shown). Note that the above-described respective sensors supply their detection signals to the control unit 5.

Next, the intermediate transfer unit will be described in detail.

The material of intermediate transfer member 30, made of PET (polyethylene terephthalate), PVdF (polyvinylidene fluoride) or the like, is supported with the driving roller 32, the tension roller 33 and the driven roller 34. The driving roller 32, having a coat of rubber (urethane or chloroprene) with a thickness of several mm on a metal roller surface, prevents slip on the belt. The driving roller 32 is rotate-driven by a stepping motor (not shown). On the rear side of the intermediate transfer member 30, the primary transfer rollers 35*a* to 35*d* respectively corresponding to the photosensitive drums 11*a* to 11*d* are provided in positions opposite to the respective photosensitive drums 11*a* to 11*d*. Further, the secondary transfer roller 36 is provided in a position opposite to the driven roller 34, and form the secondary transfer area with the nip between the intermediate transfer member 30 and the secondary transfer roller 36. The secondary transfer roller 36 is pressed with appropriate pressure against the intermediate transfer member 30. Further, on the intermediate transfer member 30, the cleaning unit 50 is provided on the downstream side of the secondary transfer area. As described above, the cleaning unit 50 has the cleaner blade 51 and the waste toner box 52. Further, as described above, the fixing unit 40 has the fixing roller 41*a*, the pressure roller 41*b* and the inner sheet discharge roller 44.

On the other hand, the sheet P fed to the registration roller 25 is stopped by stoppage of rotation driving of a roller upstream of the registration roller 25. Then, at timing of image formation by the image forming unit, the rotation driving of the upstream roller including the registration roller 25 is resumed, thereby the feeding of the sheet P is resumed. The sheet P fed as above is sent to the secondary transfer area. In the secondary transfer area, an image on the intermediate transfer member 30 is transferred onto the sheet P, then the transferred image is fixed to the sheet P in the fixing unit 40. The sheet P on which the image has been fixed is passed through the inner sheet discharge roller 44, and a feeding destination of the sheet P is switched by the switching flapper 73. When the switching flapper 73 is switched on the face-up sheet discharge side, the sheet P is discharged with the outer sheet discharge roller 45 onto the face-up sheet discharge tray 2. On the other hand, in a case that the switching flapper 73 is switched on the face-down sheet discharge side, the sheet P is fed toward the rollers 72*a*, 72*b* and 72*c*, and discharged onto the face-down sheet discharge tray 3.

Further, in a case that images are printed on both surfaces of the sheet P, the sheet P on which an image has been fixed is temporarily fed toward the face-down sheet discharge tray 3. Then, when the rear end of the sheet arrives at the reverse position A, the sheet P is stopped. Next, the sheet P is fed toward the rollers 74*a* to 74*d* by reversing the rotational direction of the rollers 72*a* to 72*c*. Thereafter, as in the case of the feeding of the sheet P from the sheet cassettes 21*a* to 21*d*, the sheet P is fed to the position of the secondary transfer roller 36. Note that plural sensors to detect presence/absence of the sheet P are provided on the feeding path of the sheet P. These sensors include the sensors 64*a* to 64*d*, the deck sheet feeding sensor 65, the deck drawing sensor 66, the registration sensor 67, an inner sheet discharge sensor 68, the face-down sheet discharge sensor 69, the double side pre-registration sensor 70, the double side paper re-feed sensor 71 and the like.

Further, the sheet cassettes 21*a* to 21*d* holding the sheets P are respectively provided with the cassette sheet presence/absence sensors (63*a* to 63*d*) to detect presence/absence of the sheet P. Further, the manual feed tray 27 is provided with the manual feed tray sheet presence/absence sensor 76 to detect presence/absence of the sheet P on the manual feed tray 27. The deck 28 is provided with the sheet presence/absence sensor 75 to detect the presence/absence of the sheet P in the deck 28.

The console unit 4 is provided on an upper surface of the image forming apparatus 1. By operating the console unit 4, selection of a sheet feeding unit containing the sheets P (the sheet cassettes 21*a* to 21*d*, the manual feed tray 27 or the deck 28), selection of a sheet discharge tray (the face-up sheet discharge tray 2 or the face-down sheet discharge tray 3), designation of a tabulating sheet stock and the like can be made. Further, upon occurrence of paper jam, a message indicating the occurrence of the paper jam, a picture indicating jam position information or the like is displayed on the display unit of the console unit 4, to prompt removal of jammed sheet.

Next, the electrical configuration of the controller 5 will be described with reference to FIG. 2.

FIG. 2 is a block diagram showing the configuration of the control unit 5 of the image forming apparatus 1 according to the exemplary embodiment and its input and output signals.

The control unit 5 has the CPU 501, a ROM 502 holding a program performed by the CPU 501 and the like, a RAM 503 holding various data, and the like. Numeral 504 denotes a solenoid; numeral 203 denotes the feeding motor; numeral 505 denotes the sheet feeding motor; and numeral 506 denotes the registration motor to rotate the registration roller 25. Further, as elements related to image formation processing, the laser drivers 204*a* to 204*d* to perform the above-described laser light emission are provided. Further, the high voltage source 201 for secondary transfer to apply a high voltage to the secondary transfer roller 36 to transfer a formed image from the intermediate transfer member 30 onto the sheet P is provided. When the high voltage source 201 is turned ON, an image can be transferred from the intermediate transfer member 30 onto the sheet P in the secondary transfer area. On the other hand, when the high voltage source 201 is turned OFF, the formed image on the intermediate transfer member 30 can be left on the intermediate transfer member 30 without being transferred onto the sheet P. The downstream cleaning unit 50 cleans toner remaining on the intermediate transfer member 30. The cleaning is performed mainly for preventing contamination of the secondary transfer roller 36 by arrival of the formed image on the intermediate transfer member 30 to the secondary transfer area when the sheet P has not arrived to the secondary transfer area, thereby preventing contamination of the rear surface of the sheet P with the contamination of the secondary transfer roller 36.

The control unit 5 has a control board (not shown) to control operations of the mechanisms in the above-described respective units, a motor drive board (not shown) and the like. Note that FIG. 2 shows only blocks necessary for explaining the features of the present embodiment.

The CPU 501 controls the operation of the entire image forming apparatus 1. A control program for this control is stored in the ROM 502, and temporary data necessary for the control is stored in the RAM 503 and appropriately read from the RAM 503. The CPU 501 has a timer 501*a* having plural time measuring functions. One of the time measuring functions is used for counting the BD signals and generating a predetermined timing signal. Further, another timer function is used for counting an internal clock of the CPU 501 and generating a predetermined timing signal. Further, the CPU 501 outputs the image formation start signal upon start of image formation for one page. By the output of the image formation start signal, image exposure by the respective scanners 13*a* to 13*d* is started. From the start of the image exposure, the BD signal is counted by a predetermined number, and the registration motor 506 is driven to rotate the registration roller 25. On the other hand, after elapse of appropriate time period from the start of the image exposure, a feeding operation of the sheet P is started such that the feeding of the sheet P follows the start of rotation drive of the registration roller 25. Thus, the image formation and the feeding of the sheet P can be synchronized with each other. Note that in the present embodiment, stepping motors are employed as the registration motor 506 and the sheet feeding motor 505. Further, the control unit 5 performs transmission/reception of control signals and image data to/from the image controller 3000 to be described later through an external I/F unit 206.

Next, the image controller 3000 will be described with reference to FIG. 3.

Figure 3:
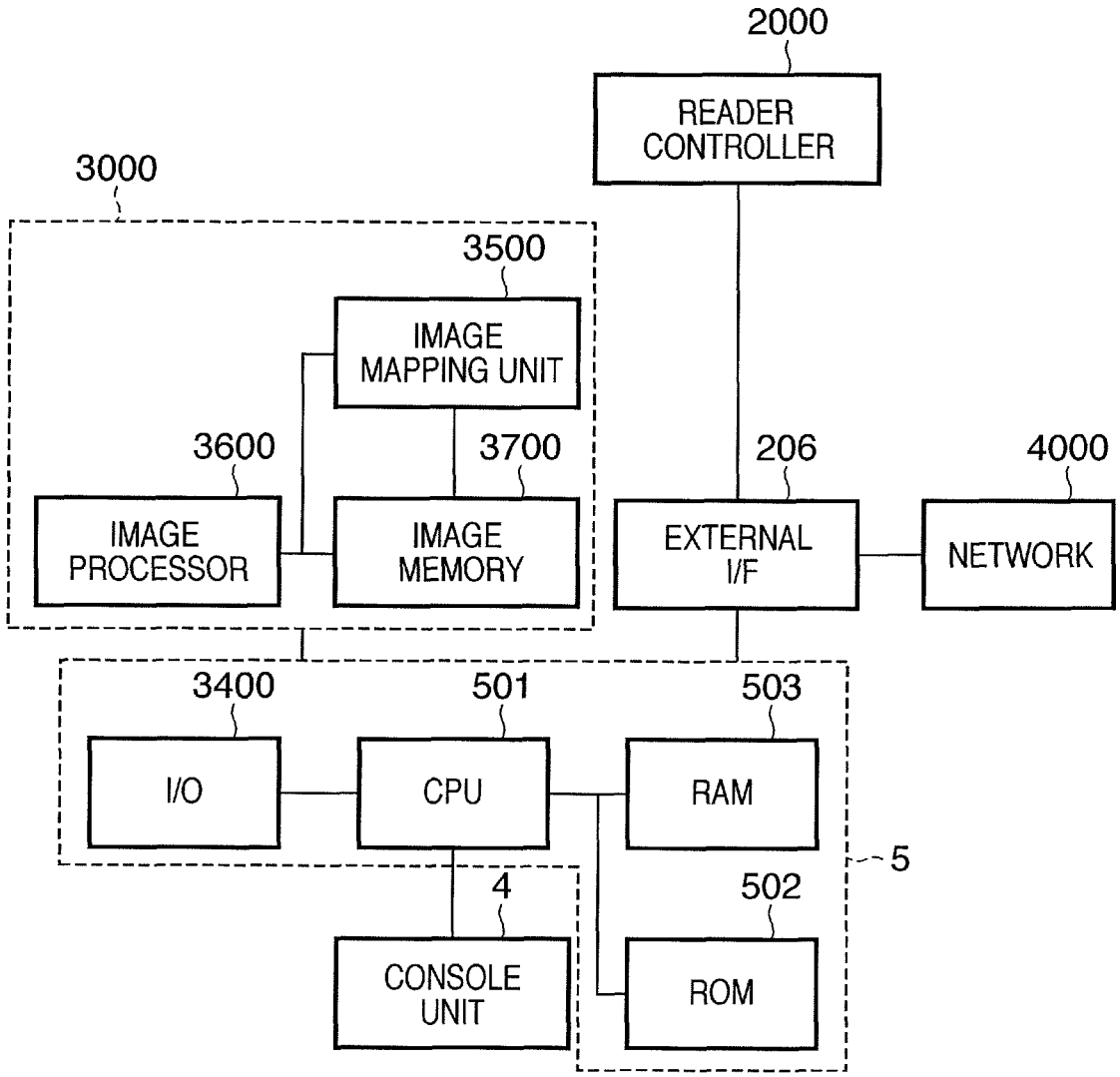
FIG. 3 is a block diagram showing units for execution of image processing in the image forming apparatus according to the exemplary embodiment.

FIG. 3 is a block diagram showing units for execution of image processing in the image forming apparatus 1 according to the present embodiment. Note that in FIG. 3, an image mapping unit 3500 and an image processor 3600 may be realized as hardware units or they may be realized as the CPU 501 and its control program.

In the control unit 5, an I/O port 3400 is connected to the CPU 501 via an address bus and a data bus. The CPU 501 is further connected to the console unit 4 of the image forming apparatus 1. The image controller 3000 includes the image processor 3600 to perform processing on image data and an image memory 3700 to store image data processed by the image processor 3600. The external I/F unit 206 is connected to a reader controller 2000 and a network 4000. In this arrangement, image data stored in the image memory 3700, for example, can be outputted to the control unit 5 or image data, read by a reader (not shown) and inputted via the reader controller 2000, for example, can be stored via the external I/F unit 206 and the control unit 5 into the image memory 3700. Further, PDL data or the like from a network client connected to the network 4000 can be received by the external I/F unit 206 and can be stored via the control unit 5 into the image memory 3700.

The reader controller 2000 is connected when, e.g., a reader unit (not shown) is connected via the external I/F unit 206. In this arrangement, plural pages of original placed on the reader unit can be continuously read at a high speed. The read image data of the original image is inputted via the control unit 5 into the image controller 3000 and stored into the image memory 3700. Then in the image controller 3000, predetermined image processing is performed on the image data stored in the image memory 3700, and mapped by the image mapping unit 3500 as bit map data and stored into the image memory 3700. The image data stored in the image memory 3700 is print-outputted under the control of the control unit 5. Note that as the image data mapped by the image mapping unit 3500 is handled in page units, it is deleted when image formation for one page has been performed, then image data for the next page is mapped.

Next, an operation in normal image formation and retry control upon occurrence of sheet feeding delay of the sheet P will be described with reference to FIGS. 4 and 5.

Figure 4:
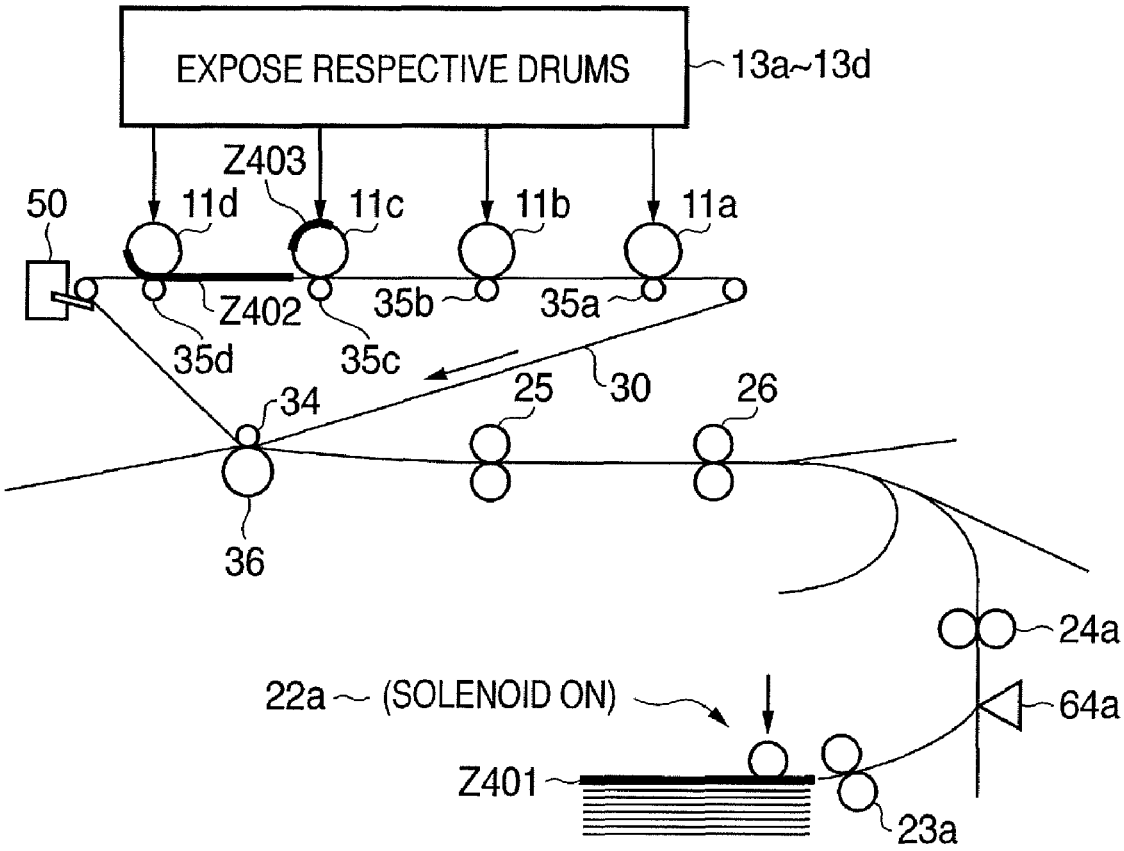
FIG. 4 depicts an explanatory view of a normal feeding status upon feeding of a sheet P in the image forming apparatus according to the exemplary embodiment.

FIG. 4 depicts an explanatory view of a normal feeding status upon feeding of the sheet P in the image forming apparatus 1 according to the exemplary embodiment.

In FIG. 4, exposure of a yellow image on the photosensitive drum 11*d* by the scanner 13*d* is completed. An image Z402, exposed and developed with Y toner, is transferred with the primary transfer roller 35*d* onto the intermediate transfer member 30. Further, with a time shift corresponding to the difference between the primary transfer roller 35*d* and the primary transfer roller 35*c*, exposure of a magenta image is performed by the scanner 13*c* on the photosensitive drum 11*c* (an exposed image is denoted by reference numeral Z403). In this status where image formation on the photosensitive drums 11 and transfer onto the intermediate transfer member 30 have been already started, sheet feeding is started at timing corresponding to a sheet feeding position. In FIG. 4, sheet feeding of the sheet P from the sheet cassette 21*a* is started. Note, according to the distance between the sheet cassette and the secondary transfer roller 36, the start of exposure of yellow image and feeding start may be the same timing. In FIG. 4, when the solenoid 504 is turned ON, the pick-up roller 22*a* comes into contact with an upper surface of the sheet P (Z401 in FIG. 4) stacked on the sheet cassette 21*a*. In this status, the sheet feeding motor 505 is rotate-driven, thereby the sheet Z401 is fed.

Figure 5:
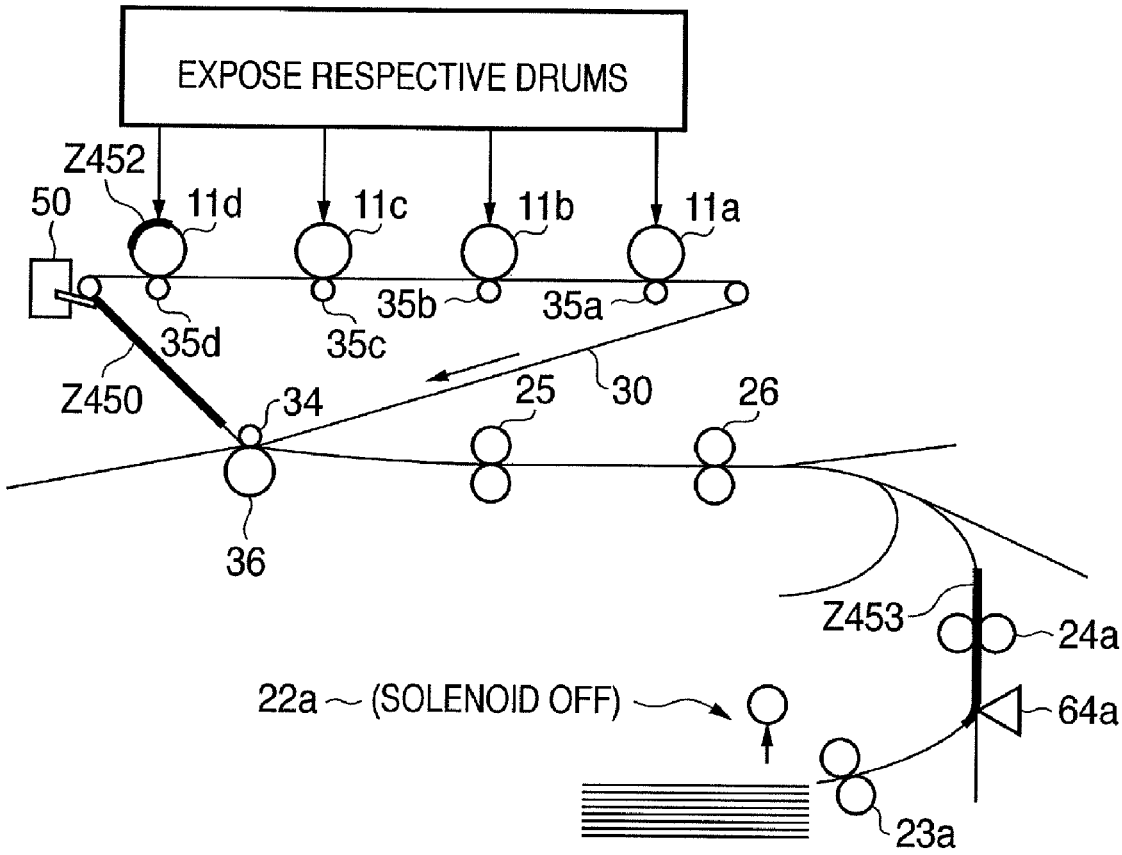
FIG. 5 depicts an explanatory view of a status when the delay of feeding of the sheet P occurs in the image forming apparatus according to the exemplary embodiment.

FIG. 5 depicts an explanatory view of a status in a case that the feeding of the sheet P is delayed in the image forming apparatus 1 according to the present embodiment.

In this example, feeding of the sheet P is delayed, and for recovery of this trouble, sheet feeding retry is performed, and in a case that the sheet feeding retry is successful, image formation retry is started. Upon completion of the sheet feeding retry, the solenoid 504 is turned OFF, thereby the pick-up roller 22*a* moves away from the upper surface of the sheet P stacked on the sheet cassette 21*a*.

When the sensor 64*a* has been turned ON, the sheet P moves ahead a little, passes through the drawing rollers 24*a* and stops in a position Z453. The position Z453 is a stop position (pre-registration stop position) in front of the feeding roller 26. In a case that the sheet feeding retry is performed, the sheet P always stops in the position Z453. This position is prepared for timing control between the fed sheet P and image formation operation.

In the intermediate transfer member 30, as the sheet feeding is delayed, the timing of arrival of the sheet P to the secondary transfer position does not follow the timing of secondary transfer, then a formed image Z450, which has not been transferred onto the sheet P, is removed by the cleaning unit 50. The formed image Z450 has not been transferred onto the secondary transfer roller 36 but left on the intermediate transfer member 30 by turn-off of the application of high voltage to the secondary transfer roller 36 (or application of a reverse bias). Next, image data for a page corresponding to the sheet P, which has fed by successful sheet feeding retry, is again transferred to the respective scanners 13*a* to 13*d* by the image controller 3000. Then, the scanner 13*d* is first driven in correspondence with Y image data, and laser exposure to the photosensitive drum 11*d* is started. Numeral Z452 denotes an electrostatic latent image formed by the exposure on the photosensitive drum 11*d*.

Figure 6:
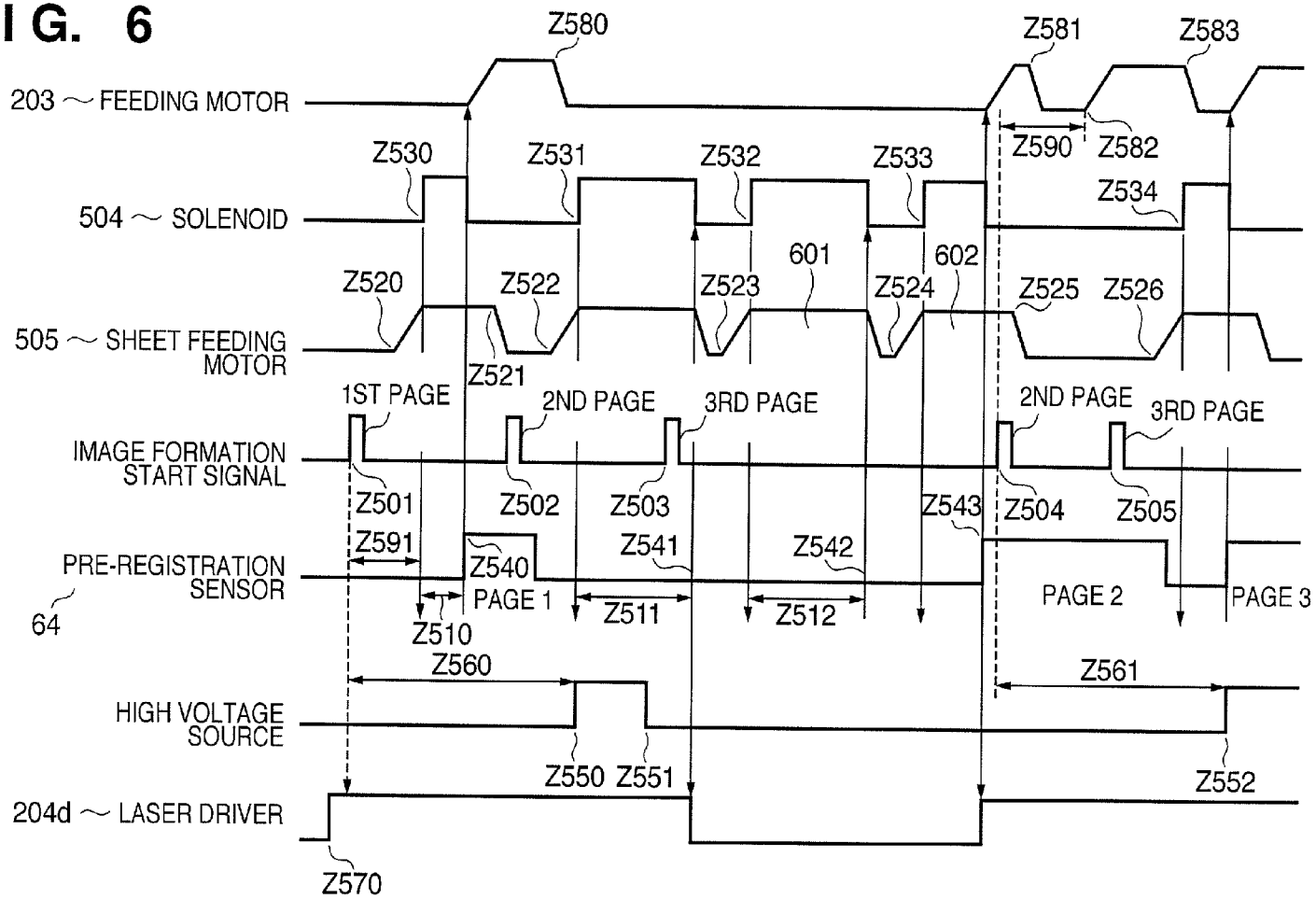
FIG. 6 is a timing chart showing sheet feeding delay processing in the image forming apparatus according to the exemplary embodiment.

FIG. 6 is a timing chart showing sheet feeding delay processing in the image forming apparatus 1 according to the present embodiment. Next, retry control upon occurrence of sheet feeding delay of the sheet P will be described with reference to FIG. 6.

FIG. 6 shows a timing chart of image formation for one photosensitive drum (e.g., the photosensitive drum 11*d*) upon image formation for images of the first to third pages. In this example, as the sheet feeding delay of the sheet P occurs in sheet feeding for the second page, sheet feeding retry is performed twice (601 and 602). Thereafter, in a case that the sheet feeding becomes successful in the second sheet feeding retry, image formation for the image of the second page is performed (Z504), and then, image formation for the third page is performed (Z505).

First, the CPU 501 turns the laser driver 204*d* ON prior to image formation for the image of the first page at timing Z570. The laser driver 204*d* performs control to maintain constant power of laser light before laser exposure. Then, when image data is sent from the control unit 5, laser driving control is performed in synchronization with the image data. After timing Z570, the CPU 501 outputs the image formation start signal as described above so as to perform image exposure for the first page at timing Z501. That is, the image exposure is started before the determination of whether the sheet feeding is successful or not.

In synchronization with the timing Z501, the CPU 501 starts rotation of the sheet feeding motor 505 at timing Z520 after elapse of predetermined time period. Then, when the rotational speed of the sheet feeding motor 505 becomes constant (Z530), the CPU 501 turns the solenoid 504 ON. Then the pick-up roller 22 (corresponding one of the pick-up rollers 22*a* to 22*d*) moves down onto the upper surface of the sheet P stacked on the sheet cassette 21 (corresponding one of the sheet cassettes 21*a* to 21*d*) and starts sheet feeding of the sheet P. It is determined whether or not the sheet feeding has been successful based on whether or not the sensor 64 (corresponding one of the sensors 64*a* to 64*d*) is turned ON within a predetermined elapsed time period (=Z511 and Z512) since the solenoid 504 has been turned ON. That is, it is determined whether or not the sheet feeding is successful after the image exposure is started. The sheet feeding period Z510 for feeding of the sheet P for the first page is shorter than the following ON time period Z511 (=Z512) of the solenoid 504. That is, as the sensor 64 detects the sheet P before elapse of the above-described predetermined elapsed time period (Z511), the CPU 501 determines that the sheet feeding of the sheet P has been successful.

The CPU 501 starts rotation of the feeding motor 203 at this timing of turn-on of the sensor 64 (rising of Z540), thereby the fed sheet P for the first page is fed to the downstream by rotation of the drawing roller 24 (corresponding one of the drawing rollers 24*a* to 24*d*). Further, at the same time, the CPU 501 turns the solenoid 504 OFF at this timing Z540, to stop sheet feeding of the next sheet P thereby prevent multi-feeding of the sheet P. As the sheet P for the first page has passed through the feed roller 23 (corresponding one of the feed rollers 23*a* to 23*d*) at timing Z521, the CPU 501 stops the rotation of the sheet feeding motor 505. Further, as the sheet P for the first page has passed through the drawing roller 24 (corresponding one of the drawing rollers 24*a* to 24*d*) at timing Z580, the CPU 501 stops the rotation of the feeding motor 203.

Then, at timing Z550, the CPU 501 turns the high voltage source 201 for secondary transfer ON, to start a transfer operation to transfer the image for the first page developed by exposure onto the sheet P for the first page. The image transfer for the first page is completed at timing Z551, at this time point, the high voltage source 201 is turned OFF. Note that a period Z560 from the start of the image formation to the start of the transfer (the period from Z501 to Z550) is constant. Accordingly, as shown in FIG. 6, when sheet feeding delay of the sheet P for the second page occurs, the CPU 501 maintains OFF status of the application of high voltage to the secondary transfer roller 36 (or applies a reverse bias). Thus, transfer of the image, formed and transferred onto the intermediate transfer member 30, to the above-described secondary transfer roller 36, is prevented. This operation will be described in detail below.

In this example, to start image formation for the second page, the CPU 501 outputs the image formation start signal at timing Z502. Similarly, to start image formation for the third page, the CPU 501 outputs the image formation start signal at timing Z503. Note that as intervals among the timings Z501 to Z503 are constant, constant printing productivity is ensured. As in the case of the sheet feeding of the sheet P for the first page, the sheet feeding of the sheet P on which the image of the second page is transferred is started by start of rotation driving of the sheet feeding motor 505 by the CPU 501 at timing Z522 after elapse of predetermined time period in synchronization with the image formation start timing Z502 for the second page. Then, when the rotation speed of the sheet feeding motor 505 becomes a constant speed (Z531), the CPU 501 turns the solenoid 504 ON. Then the pick-up roller 22 (corresponding one of the pick-up rollers 22*a* to 22*d*) moves down onto the upper surface of the sheet P stacked on the sheet cassette 21 (corresponding one of the sheet cassettes 21*a* to 21*d*) and starts sheet feeding of the sheet P. In the sheet feeding of the sheet P for the second page, the sensor 64 (corresponding one of the sensors 64*a* to 64*d*) is not turned ON after elapse of predetermined time period (Z511). Accordingly, in this case, the CPU 501 determines that sheet feeding delay has occurred in the sheet feeding of the sheet P for the second page. At timing Z541 of determination of the occurrence of sheet feeding delay in the sheet feeding of the sheet P for the second page, the CPU 501 turns the solenoid 504 OFF, stops the rotation of the sheet feeding motor 505, and stops driving of the laser driver 204*d*. Especially, the image exposure is stopped at the time point of stoppage of the driving of the laser driver 204*d*. In a case that the image exposure has been stopped, toner development by the developing unit 14 (14*d*) is not performed, thus wasteful consumption can be suppressed.

After this timing Z541, after a predetermined time interval (Z523 to Z541), the CPU 501 performs first sheet feeding retry of the sheet P. The predetermined time interval is necessary for stoppage of the sheet feeding motor 505 without loss of synchronism of the motor 505. At timing Z523, the CPU 501 starts rotation driving of the sheet feeding motor 505. Then, when the rotational speed of the sheet feeding motor 505 becomes constant (Z532), the CPU 501 turns the solenoid 504 ON. Then the pick-up roller 22 (corresponding one of the pick-up rollers 22*a* to 22*d*) moves down onto the upper surface of the sheet P stacked on the sheet cassette 21 (corresponding one of the sheet cassettes 21*a* to 21*d*) and starts sheet feeding of the sheet P. However, in this case, the sensor 64 (corresponding one of the sensors 64*a* to 64*d*) is not turned ON after elapse of the time interval Z512. Accordingly, in this case, the CPU 501 determines that the first sheet feeding retry has failed.

Next, at timing Z542 of the determination of the occurrence of the first sheet feeding retry, the CPU 501 turns the solenoid 504 OFF and stops the rotation of the sheet feeding motor 505 as in the case of the previous determination (Z541). Note that in this case, the laser driver 204*d* is not driven and is OFF. Then, after timing Z542, after a predetermined time interval (Z524-Z542), the CPU 501 performs second sheet feeding retry of the sheet P at timing Z524. As in the case of the previous sheet feeding retry, the rotation of the sheet feeding motor 505 is started at timing Z524, and when the rotational speed of the sheet feeding motor 505 becomes constant at timing Z533, when the solenoid 504 is turned ON. Thus the second sheet feeding retry is performed.

In this example, as a result of execution of the second sheet feeding retry 602, the sensor 64 (corresponding one of the sensors 64*a* to 64*d*) is turned ON at timing Z543. This timing Z543 occurs within the predetermined time period (Z511 and Z512) from the timing of turn-on of the solenoid 504 (Z533), the CPU 501 determines that the sheet feeding of the sheet P by the second sheet feeding retry has been successful.

At timing Z543 of the determination of success in the sheet feeding of the sheet P for the second page, the CPU 501 turns the laser driver 204*d* ON. That is, in a case that the sheet feeding retry has been successful, the timing of image formation is determined based on the sheet feeding. Prior to laser exposure based on image data, the CPU 501 performs control to maintain constant laser power. Then, when image data is sent from the image controller 3000, the CPU 501 performs laser drive control in synchronization with the image data. Further, at the same time, the CPU 501 starts rotation of the feeding motor 203 at timing Z543, to receive the sheet P for the second page with the drawing roller 24 (corresponding one of the drawing rollers 24*a* to 24*d*) and feed the sheet toward the downstream side. Further, at the same time, at this timing Z543, the CPU 501 turns the solenoid 504 OFF, thereby stops the sheet feeding of the next sheet P to prevent double-feeding. At this timing Z525, as the sheet P for the second page has passed through the feed roller 23 (corresponding one of the feed rollers 23*a* to 23*d*), the CPU 501 stops the rotation of the sheet feeding motor 505. Further, as the sheet P for the second page has arrived at the above-described pre-registration stand-by position Z453 (FIG. 5), the CPU 501 stops the rotation of the feeding motor 203. Then at timing Z504, the CPU 501 outputs the image formation start signal for the image of the second page.

Next, image formation processing for the third page is started when the CPU 501 outputs the image formation start signal at timing Z505. At this time, as the sheet P for the second page has already arrived at the pre-registration stand-by position Z453 (FIG. 5), in synchronization with this timing Z504, the CPU 501 starts rotation of the feeding motor 203 at timing Z582, after elapse of time period (Z590) longer than the elapsed time period for the first page (Z591). As described above, as the sheet P for the second page is in a position closer to the secondary transfer area than the position of the sheet cassette 21, the timing of start of feeding of the sheet P is delayed.

Then, at timing Z583, the CPU 501 determines that the sheet P for the second page has passed through the drawing roller 24 (corresponding one of the drawing rollers 24*a* to 24*d*), and stops the rotation of the feeding motor 203. Then at timing Z552, the CPU 501 turns the high voltage source 201 ON, to start transfer processing to transfer the exposed image of the second page onto the sheet P for the second page. Note that time interval Z561 from the timing Z504 of the output of the image formation start signal for the image of the second page to timing Z552 of turn-on of the high voltage source 201 (start of transfer) is constant as in the case of the time interval Z560 for the first page.

Then, as in the case of the sheet P for the first page, the sheet feeding of the sheet P for the third page is started when the CPU 501 starts rotation of the sheet feeding motor 505 in synchronization with the timing Z505 of the output of the image formation start signal for the third page, at timing Z526 after elapse of predetermined time period. Then, when the rotational speed of the sheet feeding motor 505 becomes constant (Z534), the CPU 501 turns the solenoid 504 ON. Then the pick-up roller 22 (corresponding one of the pick-up rollers 22*a* to 22*d*) moves down onto the upper surface of the sheet P stacked on the sheet cassette 21 (corresponding one of the sheet cassettes 21*a* to 21*d*) and starts sheet feeding of the sheet P. Since the processing thereafter is the same as that for the first page, the explanation of the processing will be omitted.

Next, the sequence of sheet feeding of the sheet P in normal times and that upon occurrence of delay of sheet feeding will be described using the flowcharts of FIGS. 7A and 7B.

Figure 7A:
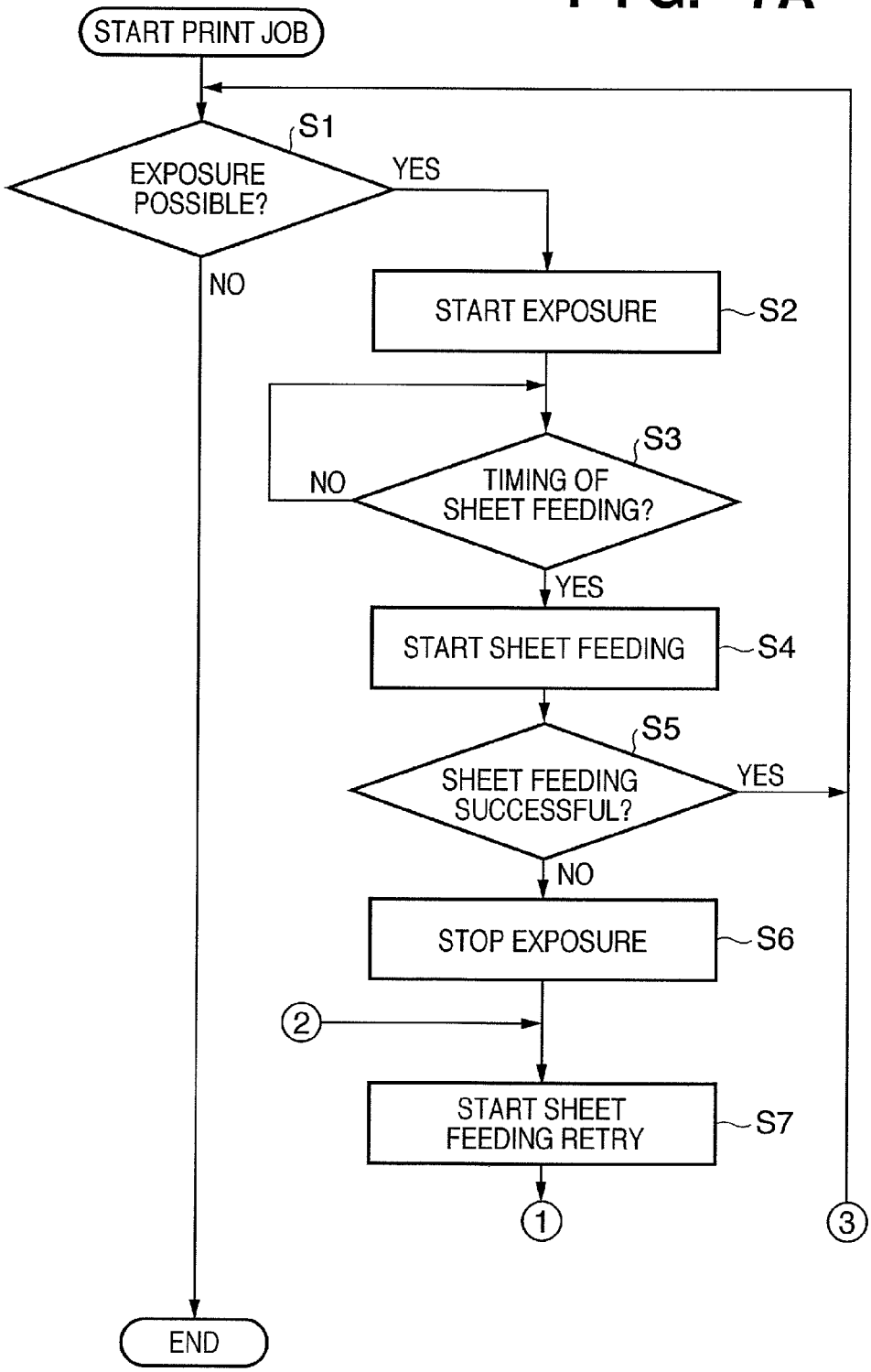
FIGS. 7A and 7B are flowcharts showing print job execution processing in the image forming apparatus according to the exemplary embodiment.
Figure 7B:
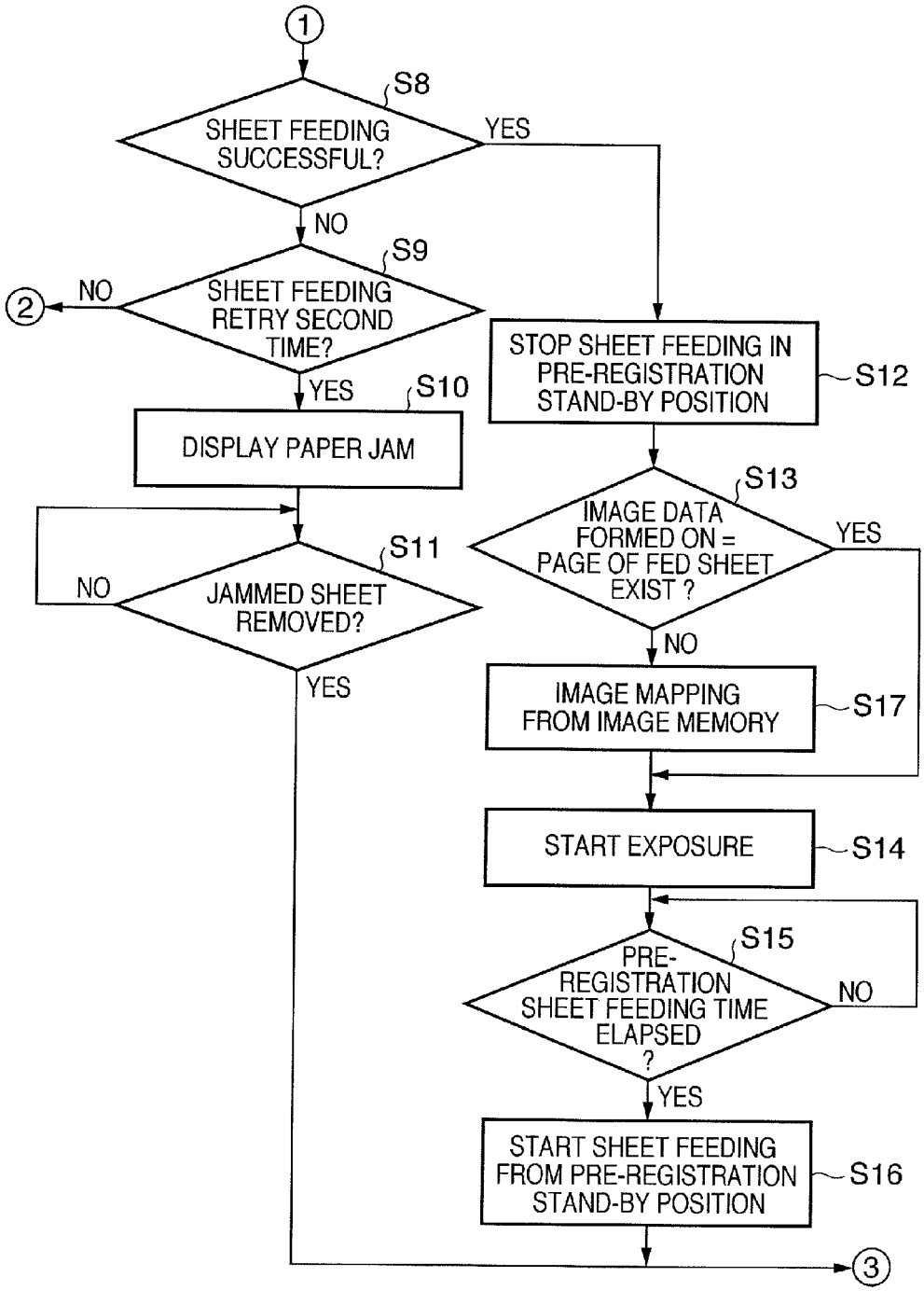

FIGS. 7A and 7B are flowcharts showing print job execution processing in the image forming apparatus 1 according to the present embodiment. A program for execution of this processing is stored in the ROM 502, and performed under the control of the CPU 501.

First, in step S1, the CPU 501 determines whether or not exposure is possible. The determination at this step S1 is made based on whether or not image data exists in the above-described image memory 3700. When it is determined in step S1 that exposure is not possible, the process ends. On the other hand, in a case that it is determined in step S1 that exposure is possible, the process proceeds to step S2, at which the CPU 501 starts an exposure operation. As described above, the exposure operation is exposure by emission of laser light from the scanner(s) 13 (13*a* to 13*d*) corresponding to the respective color image data to the respectively corresponding photosensitive drum(s) 11 (11*a* to 11*d*). Then the process proceeds from step S2 to step S3, at which the CPU 501 waits for an elapse of the predetermined time period (sheet feeding timing) Z591 from the start of exposure. The timing differs in accordance with the number of sheet cassette 21 (corresponding one of the sheet cassettes 21*a* to 21*d*). Since time period necessary for sheet feeding of the sheet P is longer as the position of the sheet cassette 21 from the secondary transfer area is farther, the time interval before start of sheet feeding is shorter. The time interval is also shorter when a sheet feeding deck is provided in addition to the sheet cassette 21. In FIG. 6, the stand-by time period before the sheet feeding is denoted by Z591. Then in step S3, in a case that the CPU 501 determines that the time period before the sheet feeding timing (Z591) has elapsed, the process proceeds to step S4, at which the sheet feeding of the sheet P from the sheet cassette 21 is started. As described above, as the sheet feeding of the sheet P, the CPU 501 turns the solenoid 504 ON to move the pick-up roller 22 (corresponding one of the pick-up rollers 22*a* to 22*d*) down onto the upper surface of the sheet P and feed the top sheet P. Further, in step S4, the CPU 501 clears a retry counter to count the number of sheet feeding retries to be described later to "0". The retry counter is provided in the RAM 503.

Then the process proceeds from step S4 to step S5, in which the CPU 501 determines whether or not the sheet feeding of the sheet P has been successful. The determination of success/failure of sheet feeding is made by determining whether or not the sensor 64 (corresponding one of the sensors 64*a* to 64*d*) has been turned ON within a predetermined time period (Z510) as described in FIG. 6. When the CPU 501 determines in step S5 that the sheet feeding of the sheet P has been successful, the process returns to step S1 since the sheet feeding has been normally performed.

On the other hand, in a case that the CPU 501 determines in step S5 that the sheet feeding of the sheet P has not been successful, the process proceeds to step S6, in which the CPU 501 stops the exposure operation. The stoppage of exposure operation in step S6 is turning the laser driver 204 OFF as described above. Note that FIG. 6 shows the laser driver 204*d*, but the laser drivers 204*b*, 204*c* and 204*a* corresponding to other color image data are also turned OFF. The process proceeds from step S6 to step S7, at which the CPU 501 starts sheet feeding retry. As described in FIG. 6, the sheet feeding retry is performed by turning the sheet feeding motor 505 and the solenoid 504 ON/OFF. At this time, the count value of the retry counter is incremented by 1 (+1).

Then the process proceeds from step S7 to step S8, in which the CPU 501 determines whether or not the sheet feeding retry of the sheet P has been successful. The determination of success/failure of the sheet feeding retry in step S8 is made by determining whether or not the sensor 64 (corresponding one of the sensors 64*a* to 64*d*) has been turned ON within a predetermined time period (Z512) from the start of the sheet feeding retry as described in FIG. 6. In a case that the CPU 501 determines in step S8 that the sheet feeding of the sheet P has not been successful, the process proceeds to step S9, in which the CPU 501 determines whether or not the value of the retry counter indicates the second time. In a case that the CPU 501 determines in step S9 that the value of the retry counter does not indicate the second time, the process returns to step S7. On the other hand, in a case that the CPU determines at step S9 that the value of the retry counter indicates the second time, the process proceeds to step S10, in which a message informing a user of a jam position or a picture indicating jam position information on the console unit 4. Thus the user is prompted to remove the jammed sheet. Thereafter, the process proceeds from step S10 to step S11, in which the CPU 501 determines whether or not the jammed sheet P has been removed by the user. The determination as to whether or not the jammed sheet P has been removed is made by using a sensor in the sheet P feeding path. In a case that the CPU 501 determines in step S11 that the jammed sheet P has been removed, the process returns to step S1.

Further, in a case that the CPU 501 determines in step S8 that the sheet feeding retry of the sheet P has been successful, the process proceeds to step S12, in which the feeding of the sheet P is stopped in the pre-registration stand-by position Z453 (FIG. 5) as described above. Next, the process proceeds to step S13, in which the CPU 501 determines whether or not image data of corresponding page to be formed on the re-fed sheet P exists in the image mapping unit 3500 (FIG. 3). In a case that image data of the page corresponding to the detected sheet P is exposed at the sheet delay detection timing, as the image data of the page has been transferred from the image controller 3000, the CPU 501 determines that image data to be formed on the sheet P exists. On the other hand, in a case that image data of the next page is exposed at the sheet delay detection timing, as image data of the next data is inputted in the image mapping unit 3500, the CPU 501 determines that image data of corresponding page to be formed on the sheet P does not exist.

In a case that the CPU 501 determines in step S13 that image data of corresponding page to be formed on the re-fed sheet P exists in the image mapping unit 3500, the process proceeds to step S14, in which the exposure operation based on the image data of the corresponding page is started. That is, the exposure operation of the image to be formed on the re-fed sheet P is started, regardless of timing of success of re-feeding, based on the detection of re-fed sheet P by the sensor 64. As described above, the exposure operation is exposure by emission of laser light from the scanner(s) 13 (13*a* to 13*d*) corresponding to the respective color image data to the respectively corresponding photosensitive drum(s) 11 (11*a* to 11*d*). Then the process proceeds from step S14 to step S15, in which the CPU 501 waits for an elapse of a predetermined time period (=pre-registration sheet feeding time period) from the start of exposure. As described in FIG. 6, the waiting corresponds to waiting for the elapsed time period of the time interval Z590. That is, as the pre-registration stand-by position Z453 is closer to the secondary transfer area than the position of the sheet cassette 21, the time interval before start of sheet feeding (Z590) is longer than the time interval (Z591) of the sheet feeding from the sheet cassette 21.

Then, when the CPU 501 determines at step S15 that the pre-registration sheet feeding time period has elapsed, the process proceeds to step S16, in which the CPU 501 resumes sheet feeding of the sheet P stopped in the pre-registration stand-by position Z453 (FIG. 5) by rotate-driving the feeding motor 203. Further, the pre-registration sheet feeding time period differs in accordance with print mode (monochrome/color print mode). Then the process returns from step S16 to step S1.

Further, in a case that the CPU 501 determines in step S13 that image data of corresponding page to be formed on the re-fed sheet P does not exist in the image mapping unit 3500, the process proceeds to step S17, in which the CPU 501 maps image data of corresponding page to be formed on the re-fed sheet P from the image memory 3700 in the image mapping unit 3500. Then the process proceeds from step S17 to step S14.

As described above, according to the present embodiment, in the image formation-first type image forming apparatus, in a case where the feeding of the sheet P does not follow the timing of arrival of an image formed on the intermediate transfer member at a transfer position, sheet feeding retry and image formation retry based on the sheet conveyance are automatically performed. This arrangement prevents occurrence of paper jam due to delay of feeding of the sheet P.

Note that in the above-described embodiment, an image forming apparatus using an intermediate transfer member is employed, however, the present invention is not limited to this apparatus. The invention is also applicable to an image forming apparatus to form an image by directly transferring an image from a photosensitive drum onto a sheet. For example, the present invention is applicable to an apparatus in which the distance from an exposure position to a transfer position is longer than that from a particular sheet feeding unit to the transfer position.

Further, in the above-described embodiment, in the image formation first method, in a case that it is determined that sheet feeding has not been successful, the exposure operation is stopped. However, the present invention is not limited to this arrangement, but the transfer operation, for example, may be stopped in a case that the determination has been made before the transfer operation, otherwise, the developing operation may be stopped.

Further, in an image forming apparatus having plural image forming units for plural colors as shown in FIG. 4, in a case where image formation timing differs by image forming unit, image formation processing (exposure, development and transfer) is stopped in the respective image forming units in a case that it is determined that sheet feeding has not been successful. Accordingly, in this case, image formation operations stopped in the image forming units may be different.

Note that the present invention can be implemented by supplying a software program, which implements the functions of the foregoing embodiment, directly or indirectly to a system or apparatus, reading the supplied program with a computer of the system or apparatus, and then executing the program. In this case, as long as the system or apparatus has the functions of the program, the mode of implementation need not rely upon a program.

Accordingly, since the functional processing of the present invention is implemented by the computer, the program code installed in the computer also implements the present invention. In other words, the claims of the present invention also cover a computer program for the purpose of implementing the functional processing of the present invention. In this case, as long as the system or apparatus has the functions of the program, the program may be executed in any form, such as an object code, a program executed by an interpreter, or script data supplied to an operating system.

Example of storage media that can be used for supplying the program are a floppy (registered trademark) disk, a hard disk, an optical disk, a magneto-optical disk, an MO, a CD-ROM, a CD-R, a CD-RW, a magnetic tape, a non-volatile type memory card, a ROM, and a DVD (a DVD-ROM and a DVD-R).

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2006-202587, filed Jul. 25, 2006, and Japanese Patent Application No. 2007-169490, filed Jun. 27, 2007, which are hereby incorporated by reference-herein in their entirety.

What is claimed is:

1. An image forming apparatus comprising:

a sheet containing unit configured to contain sheets;

a feeding unit configured to feed a sheet from the sheet containing unit;

a detection unit, arranged downstream of the feeding unit, configured to detect presence/absence of the sheet which has been fed by the feeding unit;

a conveyance unit configured to convey the sheet fed by the feeding unit;

an image forming unit configured to form an image on an image carrier;

a transfer unit configured to transfer the image formed on the image carrier onto the sheet conveyed by the conveyance unit;

a determination unit configured to determine whether or not the feeding unit successfully feeds the sheet based on a detection result by the detection unit; and a control unit configured to start feeding of the sheet by the feeding unit so that the detection unit detects the presence of the sheet after start of image formation by the image forming unit, and cause the transfer unit to transfer the image formed on the image carrier onto the sheet, in a case that the determination unit determined that the feeding unit has successfully fed the sheet;

wherein, in a case that the determination unit determined that the feeding unit has not successfully fed the sheet and in a case that the detection unit does not detect the presence of the sheet within a predetermined time period from the start of the feeding of the sheet by the feeding unit, the control unit is configured to:

(a) stop the transfer of the image by the transfer unit, (b) control the feeding unit to retry feeding of the sheet that has not been successfully fed as determined by the determination unit, (c) control the image forming unit not to start formation of an image to be formed on the sheet until the determination unit determines that the feeding unit successfully feeds the sheet by the retry feeding, and (d) stop the sheet fed by the retry feeding at a predetermined position downstream of the detection unit and restart feeding of the sheet fed by the retry feeding at a predetermined timing after the starting of formation of the image.

2. The apparatus according to claim 1, wherein, in a case where the determination unit does not determine that the feeding unit has successfully fed the sheet even if the retry feeding of the sheet determined by the determination unit that has not been successfully fed is performed a predetermined number of times, the control unit notifies that the sheet is jammed.

3. The apparatus according to claim 1, wherein the feeding unit further has a pick-up unit to pick up a sheet from a containing unit to contain plural sheets and supply the sheet.

4. The apparatus according to claim 1, wherein the image carrier is a photosensitive drum.

5. The apparatus according to claim 1, wherein the image carrier is an intermediate transfer member.

* * * * *